United States Patent [19]

Rozzi

[11] Patent Number: 4,875,322

[45] Date of Patent: Oct. 24, 1989

[54] PROCESS FOR THE INSULATION OF EXISTING BUILDING FACADES AND PREFABRICATED PANEL TO BE USED IN APPLYING SAID PROCESS

[75] Inventor: Costantino Rozzi, Ascoli Piceno, Italy

[73] Assignee: R.E.IN. S.p.A., Italy

[21] Appl. No.: 123,173

[22] Filed: Nov. 20, 1987

[30] Foreign Application Priority Data

Dec. 12, 1986 [IT] Italy ..... 22672 A/86

[51] Int. Cl.[4] ..... E04B 1/38

[52] U.S. Cl. ..... 52/746; 52/309.7; 52/309.12; 52/454; 52/513

[58] Field of Search ..... 52/309.12, 309.7, 746, 52/506, 513, 404, 454

[56] References Cited

U.S. PATENT DOCUMENTS

| | | | |
|---|---|---|---|
| 3,362,120 | 1/1968 | Warren | 52/506 X |
| 3,555,131 | 1/1971 | Weismann | 52/309.7 X |
| 4,253,288 | 3/1981 | Chun | 52/454 |
| 4,277,926 | 7/1981 | Sherman et al. | 52/303 |
| 4,320,605 | 3/1982 | Carlson et al. | 52/94 |
| 4,342,181 | 8/1982 | Truesdell | 52/746 X |
| 4,505,019 | 3/1985 | Deinzer | 52/309.12 X |
| 4,578,915 | 4/1986 | Schneller | 52/454 |
| 4,646,498 | 3/1987 | Schneller | 52/309.12 |
| 4,674,242 | 6/1987 | Oboler et al. | 52/309.7 X |

FOREIGN PATENT DOCUMENTS

| | | | |
|---|---|---|---|
| 0164332 | 12/1985 | European Pat. Off. | 52/309.7 |
| 2915977 | 10/1980 | Fed. Rep. of Germany | 52/746 |

*Primary Examiner*—Carl D. Friedman

*Attorney, Agent, or Firm*—Steele, Gould & Fried

[57] ABSTRACT

A plurality of prefabricated flat panels consisting of a three-dimensional metal grating and a surface layer of foamed plastic material is applied and fixed to the existing facade taking care to place said layer of foamed plastic material against said facade. Plaster is then applied for complete covering of the uncovered part of the metal grating.

5 Claims, 1 Drawing Sheet

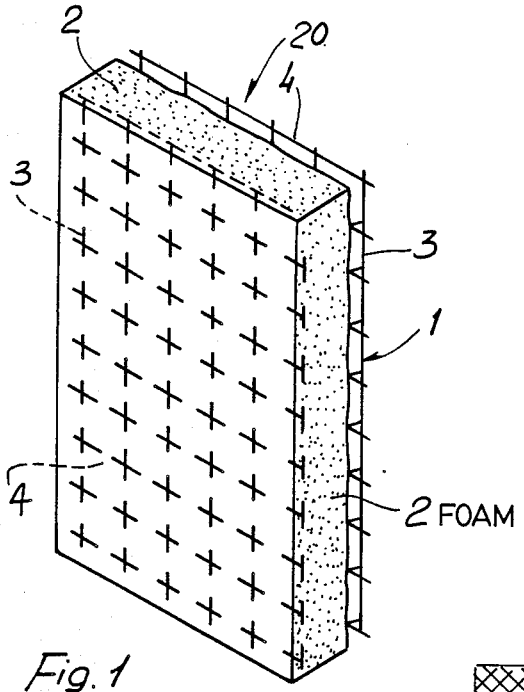
Fig. 1
Fig. 2
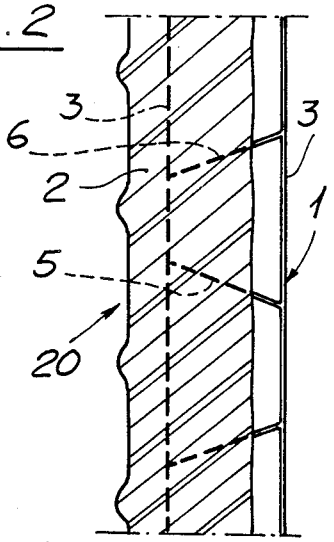
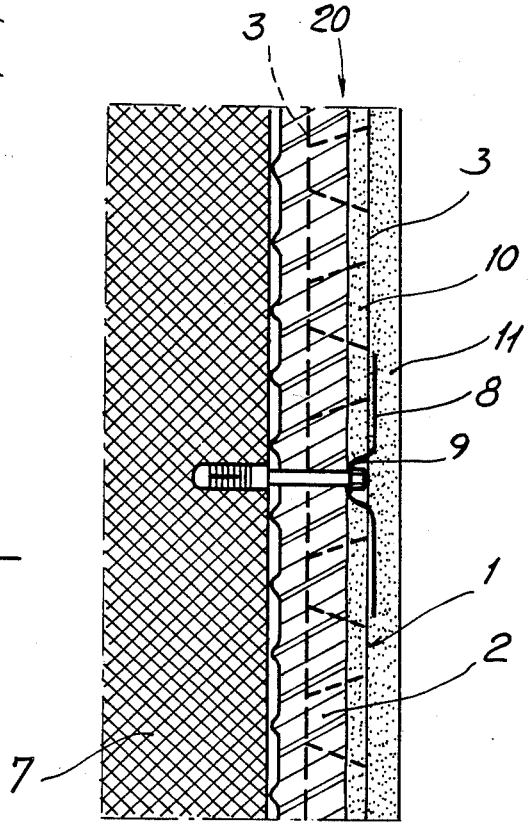
Fig. 3

PROCESS FOR THE INSULATION OF EXISTING BUILDING FACADES AND PREFABRICATED PANEL TO BE USED IN APPLYING SAID PROCESS

DESCRIPTION

The present invention relates to a process for the insulation of existing building facades and a prefabricated panel to be used in applying said process.

The work of renovating old buildings is known to comprise the reconstruction of the facade, in particular by the application of insulating material on the outside of said facade.

SUMMARY AND OBJECTS OF THE INVENTION

The object of the present invention is to provide an insulating process for the facades of existing buildings which would be low in cost and easy to apply and would produce a high-quality finished product.

The process in accordance with the invention is characterized in that it comprises covering of the existing facade with flat prefabricated panels made up of a three-dimensional metal grating and a surface layer of foamed plastic material placed next to the facade, the fixing of said prefabricated panels to said facade, and completion of the covering with plastic of a thickness such as to incorporate and cover externally said metal grating.

By using prefabricated panels of the abovesaid type, which can be produced in the factory and then cut to measure in accordance with different requirements, the process in accordance with the invention achieves the result of low cost and easy installation, this last due essentially to the lightness of the panels and the clinging of the plaster which is assured by the geometry of the metal grating of the panels. The quality of the finished product is assured by the excellent insulating effect of the layer of foamed plastic material next to the prexisting facade which functions as a thermally inert mass.

BRIEF DESCRIPTION OF THE DRAWINGS

For a better understanding of the characteristics of the present invention reference is made below to the annexed drawings wherein:

FIG. 1 shows a perspective view of a flat prefabricated panel applicable by the process in accordance with the present invention, FIG. 2 shows said panel sectioned along a vertical plane, and FIG. 3 shows a panel like that of FIGS. 1 and 2 installed on a preexisting facade.

DETAILED DESCRIPTION

The panel illustrated in FIGS. 1 and 2 indicated as a whole by reference number 20 consists of a three-dimensional metal grating 1 partially filled with a flat layer 2 of foamed plastic material, e.g. polyurethane, which protrudes laterally from one of the major faces of the grating 1.

The three-dimensional grating 1 is formed of two flat parallel nets with perpendicular wires 3 and 4 united by connecting pieces 5 and 6 alternately inclined in one direction and then in the opposite direction as can be seen in FIG. 2.

To insulate the facade of an existing building a plurality of panels of the type described, prefabricated in a factory and transported to the site where they are cut to size depending on the various requirements, is used.

The panels 20 are then applied to the facade 7 to be insulated taking care to place next to the building facade the face of the panel from which protrudes the layer of insulating material 2 (FIG. 3).

By means of metal strips 8 forming a rabbet against the uncovered net of the grating 1 and expanding plugs or anchors 9 the panels are then fixed to the facade. Alternately appropriate mortar adhesives may be used.

The part of the grating 1 not occupied by the insulating layer 2 is filled with a first layer of plaster 10 which is followed by a second layer of finishing plaster 11. The first layer 10 is preferably applied by spraying flush with the edge of the net so as to secure a uniform and rough surface. The second layer 11 is preferably applied with one pass after the setting of the first layer. On the second layer of plaster will be applied a finish, for example by trowelling or floating.

I claim:

1. Process for the insulation of existing building facades comprising the steps of covering the facade with flat prefabricated panels consisting of a three-dimensional metal grating partially embedded in a layer of foamed plastic material and placing a surface layer of said foamed plastic material, said surface layer covering and extending beyond a corresponding face of said grating, next to the facade, fixing said prefabricated panels to said facade, and completion of the coating with plastic of a thickness such as to incorporate and cover externally said metal grating.

2. Process in accordance with claim 1 characterized in that said panels are fixed with metal strips and expanding anchors.

3. Process in accordance with claim 1 characterized in that said panels are fixed by the use of adhesive mortar.

4. Process in accordance with claim 1 characterized in that said grating protrudes beyond an opposite surface of said plastic material, said plaster is applied in a first layer which fills the protruding grating portion flush with the outermost part of an uncovered face of the panel and said plaster is applied in a second layer laid over the first layer to hide said uncovered face.

5. Process in accordance with claim 1 characterized in that said foamed plastic material is polyurethane.

* * * * *